US005629731A

United States Patent [19]

Kwon

[11] Patent Number: 5,629,731

[45] Date of Patent: May 13, 1997

[54] THERMAL PRINTING APPARATUS HAVING A THERMAL PRINT HEAD AND LINE BUFFER

[75] Inventor: Sang-cheol Kwon, Suwon, Rep. of Korea

[73] Assignee: Samsung Electronics Co., Ltd., Kyungki-do, Rep. of Korea

[21] Appl. No.: 620,746

[22] Filed: Mar. 18, 1996

Related U.S. Application Data

[63] Continuation of Ser. No. 175,231, Dec. 29, 1993, abandoned.

[30] Foreign Application Priority Data

Dec. 29, 1992 [KR] Rep. of Korea ..... 92-25916

[51] Int. Cl.[6] ..... B41J 2/355

[52] U.S. Cl. ..... 347/211

[58] Field of Search ..... 347/172, 211, 347/183

[56] References Cited

U.S. PATENT DOCUMENTS

| | | | |
|---|---|---|---|
| 4,563,693 | 1/1986 | Masaki | 347/183 |
| 4,621,271 | 11/1986 | Brownstein | 347/183 |
| 4,806,949 | 2/1989 | Onuma et al. | 347/183 |
| 5,374,945 | 12/1994 | Molieri et al. | 347/183 |

*Primary Examiner*—Huan H. Tran

*Attorney, Agent, or Firm*—Sughrue, Mion, Zinn, Macpeak & Seas

[57] ABSTRACT

A thermal print head includes a line buffer which stores n-bits of data by line units, a latch register which latches the data one line at a time from the line buffer according to the bit priority, and a plurality of heating elements which emit heat according to the data latched in the latch register for printing. The thermal print head avoids the use of a line memory, gradation counter, and gradation comparator for expressing the gradation as are required by conventional devices, thereby enabling the reduction of the amount of hardware necessary for printing, yet still achieving high speed printing.

13 Claims, 5 Drawing Sheets

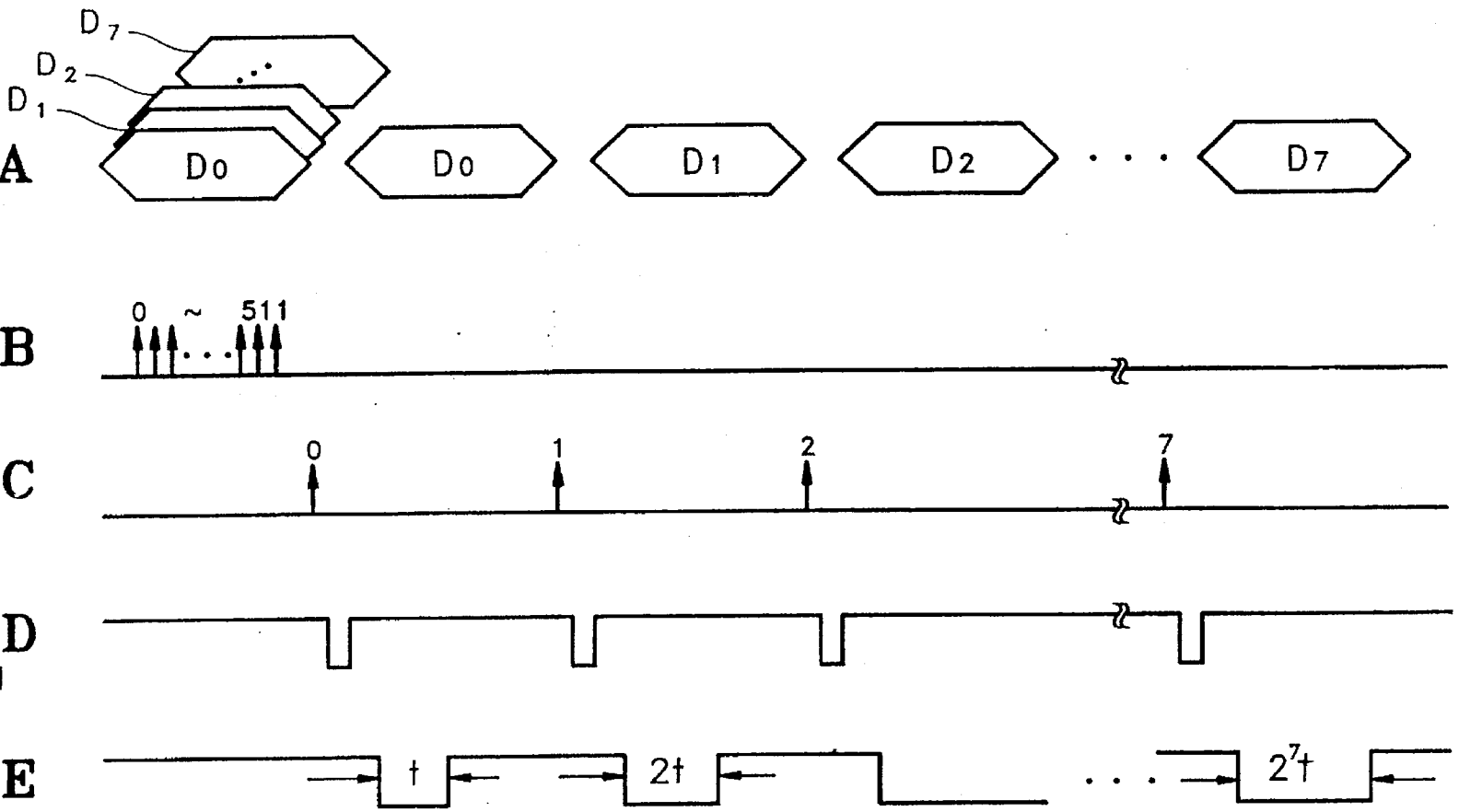
FIG. 5A DATA
FIG. 5B SCLK
FIG. 5C PCLK
FIG. 5D LATCH
FIG. 5E ENABLE (STROBE)

THERMAL PRINTING APPARATUS HAVING A THERMAL PRINT HEAD AND LINE BUFFER

This is a continuation of application Ser. No. 08/175,231 filed Dec. 29, 1993 abandoned.

BACKGROUND OF THE INVENTION

The present invention relates to a thermal printing apparatus having a thermal print head provided with a line buffer. More particularly, the invention relates to a thermal printing apparatus which employs a thermal print head and line buffer in order to reduce the amount of hardware, while still achieving high speed printing.

As is well known, a thermal print head converts electrical signals into thermal energy in order to print by sublimating dye. A video printing apparatus (also known as a "color image printer") prints using this type of a thermal print head (TPH). For instance, a video printing apparatus sublimates dye of the dye-deposited film by the heat-energy generated by the thermal print head, which is energized by applying current thereto. The print head then prints the desired image or picture depending on the amount of the dye printed on the recording paper.

The conventional sublimate-type thermal printing apparatus which prints using a TPH is shown in FIG. 1. The apparatus includes a system controller ("syscon") 1 for controlling the overall operation of the system. The apparatus receives image signals from a signal source, such as a video camera, television, personal computer, graphic computer, etc. The red (R), green (G), and blue (B) signals input from the signal source are stored in units of frames in a frame memory 3 under the control of a memory controller 2, which controls the timing for reading and writing of data.

A selector 4 selects the R, G, and B signals that are stored in the frame memory 3 one by one, under the control of the syscon 1. A color converter 5 converts the selected signal into a complementary color; the selected B signal is converted into a yellow (Y) signal, the selected G signal into a magenta (M) signal, and the selected R signal into a cyan (C) signal, respectively. A corrector 6 corrects the output of the color converter 5 using such methods as gamma correction, color correction, resistance correction, and a temperature correction. The corrected signals are then stored in a line memory 7.

Meanwhile, the image data that is stored in the line memory 7 and the gradation data generated from a gradation counter 8 are compared by a gradation comparator 9 for printing. In addition, if the image data read from line memory 7 is larger than the gradation data of gradation counter 8, a "1" is transmitted to the TPH 13; otherwise, a "0" is transmitted to the TPH 13, according to a clock signal generated from a clock signal generator 10.

Next, the data corresponding to the amount of one line is transmitted to the TPH 13, which then is latched by a latch signal LATCH generated from a latch signal generator 11. The latched data is then printed according to the strobe signal STROBE, which is generated from a strobe signal generator 12 in order to enable each heating element.

As shown in FIG. 2, which is a detailed circuit diagram of the TPH 13, the data whose gradation is compared in the gradation comparator 9, as described above, is stored in a shift register 14 by one bit according to the clock signal. When the data corresponding to one line amount is stored in the shift register 14, the data is output of the shift register 14 and is stored into a latch register 15 according to the latch signal. Here, the number of the heating elements for heating one line equals 512, as an example. The heating element 16, which is composed of resistors RO–R511, is electrified and emits heat depending on the two inputs to the NAND gates G0–G511; the two inputs including the strobe signal generated from the strobe signal generator 12 and the data stored in latch register 15.

Thus, when the expression of one gradation is finished, the signal read from the line memory 7 is compared with the next gradation value of the gradation counter 8 through the gradation comparator 9 in order to express the next gradation. The output of the gradation comparator 9 is transferred to the TPH 13, and after transferring one line of data, the transferred data is latched in the latch register. Then, the predetermined gradation (here, 256 gradations) is expressed during the strobe signal.

Thus, if the image data is transferred to the TPH 13, which has 512 heating elements, by inputting single-bit data, the size of the block of the TPH 13 is 512. Therefore, if the clock frequency of the TPH 13 is 5 MHz, it will take 102.4 microseconds for transferring one data. Accordingly, it takes about 26 milliseconds (102.4 times 255) for emitting heat for printing one line of zero to 255 levels, i.e., 256 gradations.

Accordingly, since the time of at least 102.4 microseconds is required for expressing one gradation, it is impossible to reduce the amount of time for printing one line down to 26 milliseconds.

In addition, the pixel data stored in the frame memory 3 is transmitted to the line memory 7 one line at a time when the conventional thermal printing apparatus as shown in FIG. 1 is provided with a thermal print head as shown in FIG. 2. Further, the transmitted data of one line is gradation-compared by the gradation comparator 9, which then is transmitted to the TPH 13 so as to repeat the expression when printing up to the 255th gradation. At this time, the quantity of hardware becomes large since the line memory 7 is necessary for compensating for the difference between the transfer speed in which the pixel data is transferred to the heating elements 16 within the TPH 13 and the data reading speed of frame memory 3.

SUMMARY OF THE INVENTION

Accordingly, it is an object of the present invention to provide a thermal print head wherein a line buffer which stores line units of m-bits is provided.

It is another object of the present invention to provide a thermal printing apparatus and method thereof which decreases the necessary amount of hardware for print expression without gradation comparison by employing a thermal print head and line buffer.

It is another object of the present invention to provide a thermal printing apparatus and method thereof which does not compare the gradation but expresses print to thereby enable high-speed printing.

The above and other objects of the present invention are achieved by a thermal print head including a line buffer for storing line units of data, each line unit comprising m-bits of data, latching means, coupled to the line buffer, for latching one line unit of data at a time as output by the line buffer in accordance with bit priority, and a plurality of heating elements which emit heat according to the data latched by the latching means.

Further, the above and other objects of the invention are achieved by a thermal printing apparatus including input means for receiving an image signal, a frame memory, coupled to the input means, for storing the image signal in frame units, a thermal print head comprising a line buffer for storing line units of data, each line unit comprising m-bits of data, a latch for latching data of one line at a time from the line buffer according to the bit priority, and a plurality of heating elements for emitting heat according to the data latched by the latch, control means for controlling the reading and writing of data to and from the frame memory including the outputting of m-bits of data from the frame memory to the line buffer of the thermal print head as line units, and driving signal generating means for generating driving signals so as to control the emission of heat by the heating elements in accordance with the data stored in the line buffer.

Even further, the above objects of the present invention are achieved by a thermal printing method for controlling a thermal printing apparatus to print using a thermal print head and line buffer which stores n-bits of data by line units. The method includes the steps of storing an image signal input from a signal source by frame units in a memory, reading the frame units from the memory and storing m-bits of data for one line into a line buffer of the thermal print head, and printing by causing heating elements to emit heat according to the n-bits of data for one line as output by the line buffer in accordance with bit priority.

BRIEF DESCRIPTION OF THE DRAWINGS

The above and other objects and advantages of the present invention will become more apparent by describing in detail a preferred embodiment thereof with reference to the attached drawings in which:

FIGS. 5A to 5E are operational timing diagrams for the thermal printing apparatus of FIG. 4.

DETAILED DESCRIPTION OF A PREFERRED EMBODIMENT

The present invention will now be described in more detail with reference to the attached drawings.

Figure 3:
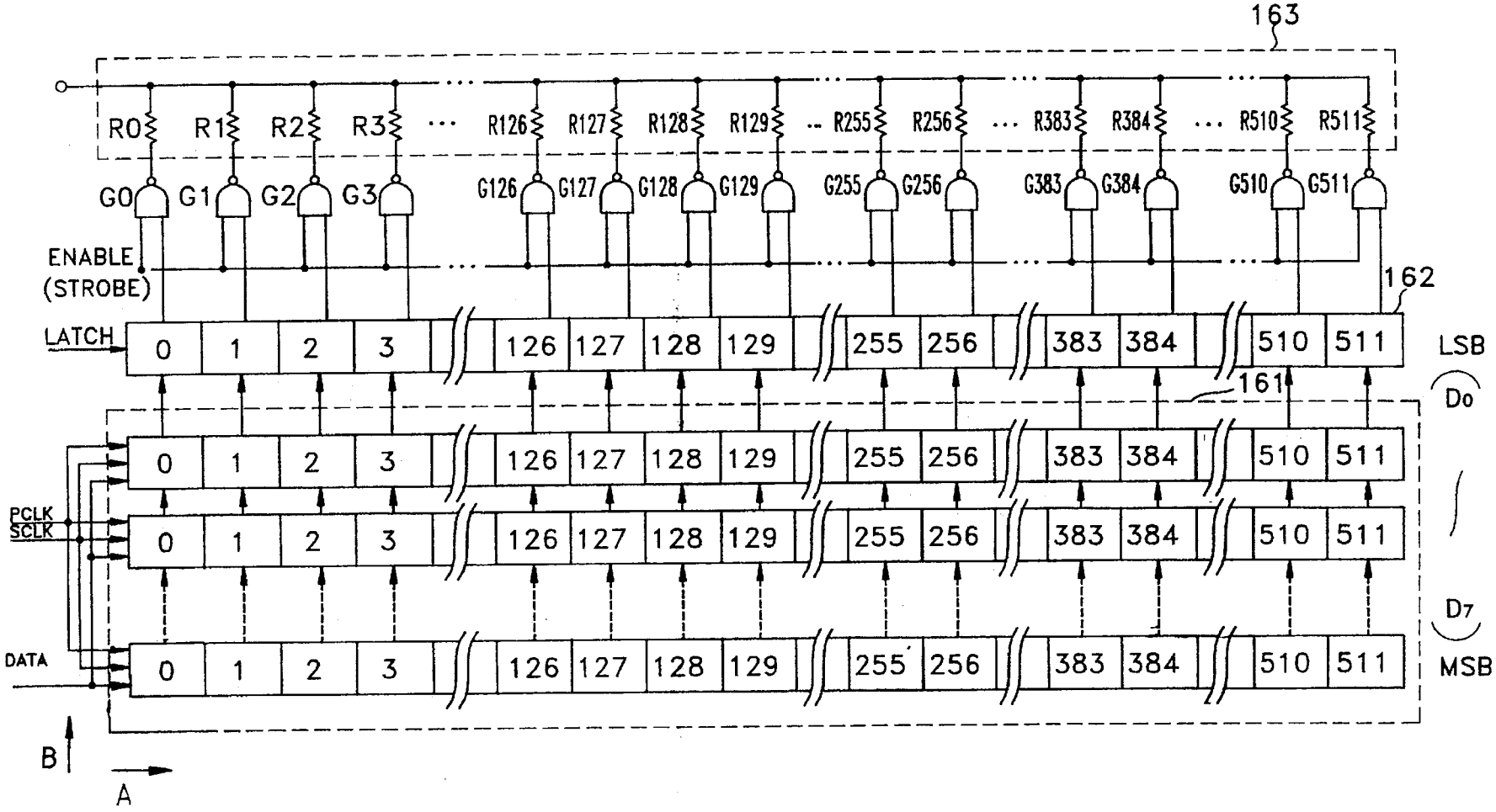
FIG. 3 illustrates the structure of the thermal print head according to a preferred embodiment of the present invention.

Referring to FIG. 3, there is shown the structure of a thermal print head according to a preferred embodiment of the present invention. The thermal print head includes a line buffer 161 composed of shift registers which store m-bit data corresponding to the amount of one-line by line unit according to the bit priority, a latch register 162 for latching the data of one line which is output from the line buffer 161 at times according to the bit priority, a heating element 163 composed of resistors R0–R511, and NAND gates G0–G511 which input data latched by the latch register 162 and which control the emission of heat by the heating element 163 according to an enable (strobe) signal.

Figure 4:
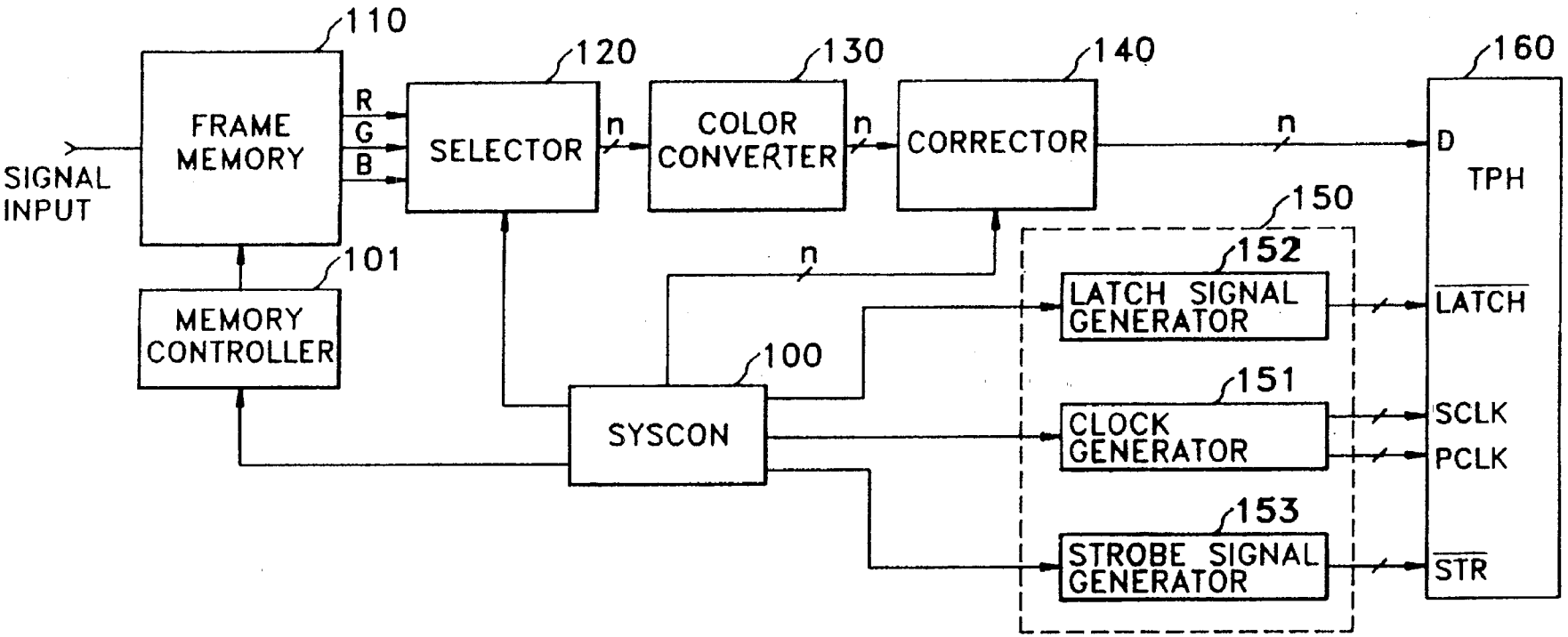
FIG. 4 is a block diagram of a preferred embodiment of the thermal printing apparatus of the present invention including the thermal print head of FIG. 3.

FIG. 4 is a block diagram of a preferred embodiment of the thermal printing apparatus, which includes the thermal print head as described above and as shown in FIG. 3.

In accordance with the present invention, the thermal printing apparatus includes the thermal print head 160, a syscon 100 which controls the overall system, a memory controller 101 which generates reading and writing addresses and which controls the timing for reading and writing of data, a frame memory 110 which receives and stores by frame units the image signal input from any one of a number of signal sources as a digital signal, a selector 120 which selects the R, G, and B signals read from the frame memory 110, a color converter 130 which converts the signal selected by the selector 120 into the respective complementary color, i.e., C, M and Y color signals, a corrector 140 which performs various corrections such as gamma-correction, resistance correction, temperature correction, and color correction on the output of the color converter 130, a driving signal generator 150 which generates driving signals so as to cause the data from the corrector 140 to be transferred to the thermal print head 160 for printing.

The driving signal generator 150 includes a clock generator 151 which generates a serial clock SCLK and a parallel clock PCLK for storing data into the line buffer 161 of the thermal print head 160. The generator 150 also includes a latch signal generator 152 which generates an enable signal (i.e., latch signal) for controlling the latch register 162, and a strobe signal generator 153 which generates the strobe signal STR that controls the period of heating of the heating elements 163.

The operation of FIGS. 3 and 4 is explained with further reference to the timing diagrams that are illustrated in FIG. 5.

Figure 1:
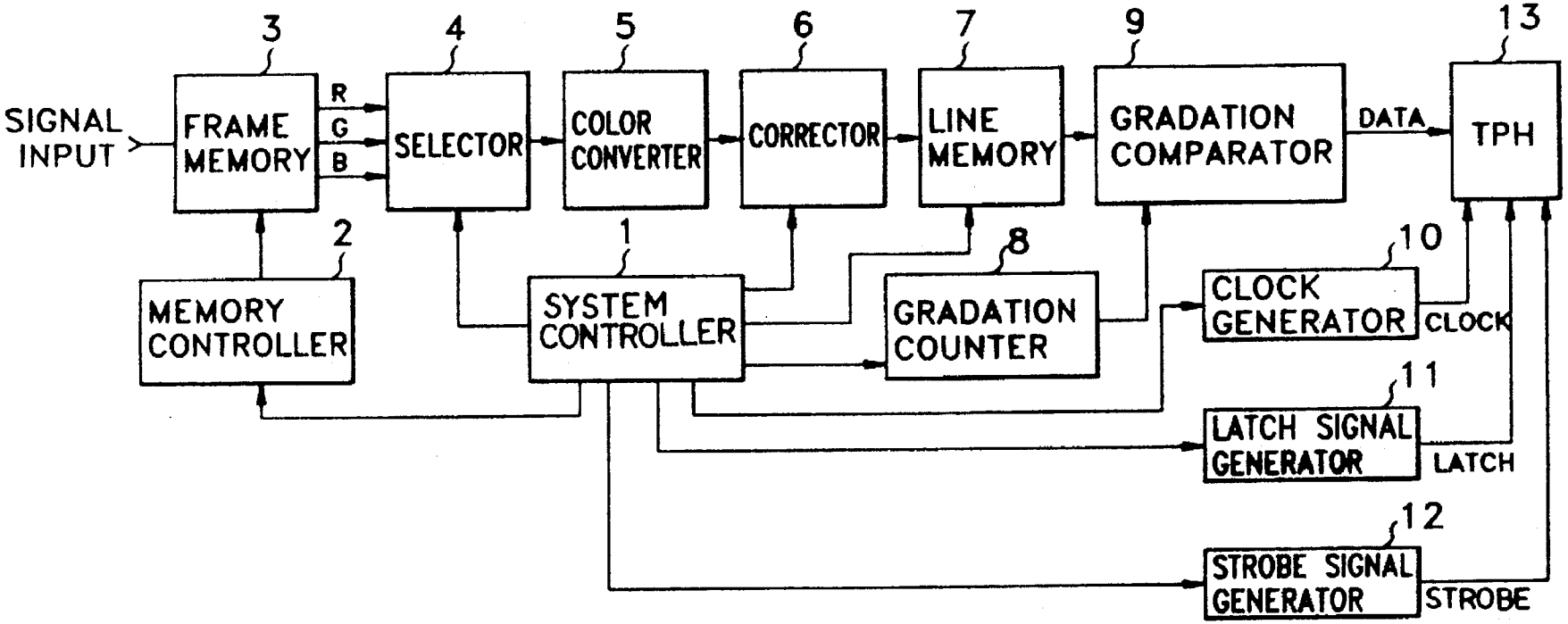
FIG. 1 (PRIOR ART)
FIG. 1 is a block diagram of a conventional thermal printing apparatus.

The structure and operation of the syscon 100, memory controller 101, frame memory 110, selector 120, color converter 130, and corrector 140 of FIG. 4 are the same as those of the syscon 1, memory controller 2, frame memory 3, selector 4, color converter 5, and corrector 6 of the conventional apparatus illustrated in FIG. 1. Thus, for the sake of brevity, a further description of these components will be omitted.

Figure 2:
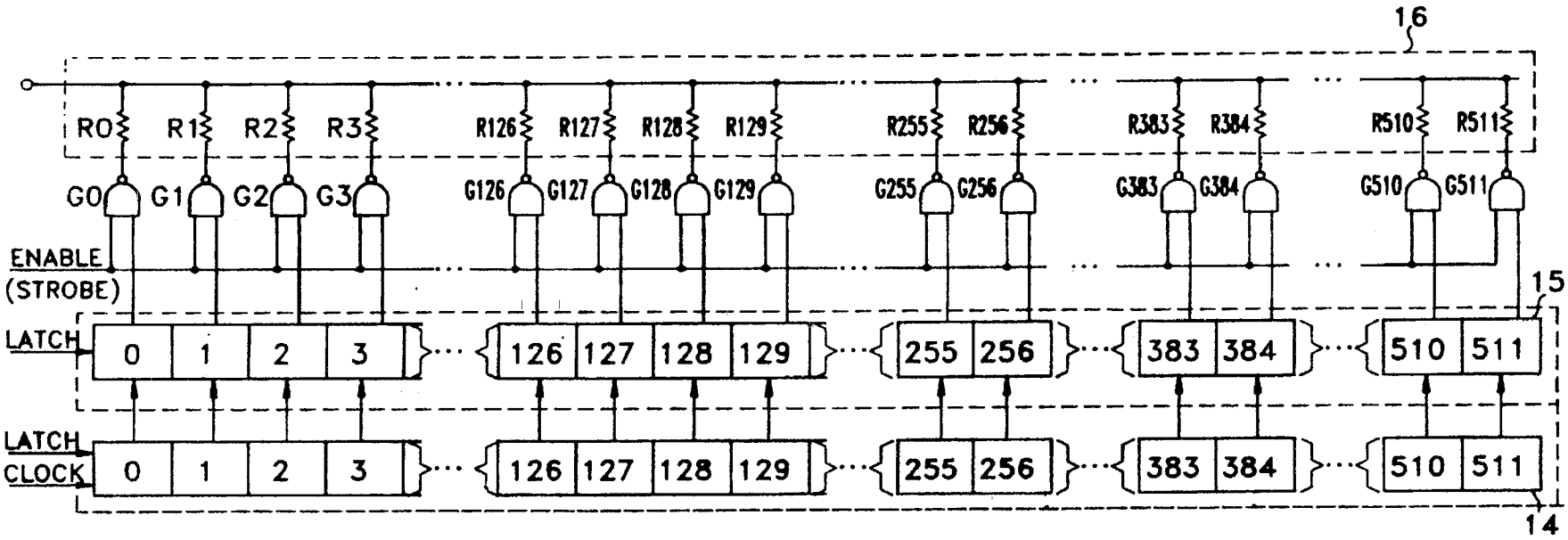
FIG. 2 (PRIOR ART)
FIG. 2 illustrates the structure of the thermal print head as shown in FIG. 1.

Since the conventional shift register 14 of the thermal print head 13 shown in FIGS. 1 and 2 is designed to store single-bit data corresponding to the amount of data for one line, there is no other way of expressing the data to be printed but by using "0" or "1". Therefore, the line memory 7 is provided separately between the frame memory 3 and TPH 13, and circuits such as the gradation counter 8 and gradation comparator 9 are required in order to express a gradation.

However, in accordance with the present invention, the conventional line memory 7, gradation counter 8, and gradation comparator 9 are not needed since the shift register 161 of the TPH 160 uses the line buffer which is designed to store one-line of data composed of m numbers of pixel data which can be expressed by n-bits, as shown in FIG.3. This aspect of the invention is explained below in more detail.

If the number m of heating elements is as shown in FIG. 5B, then the clock generator 151 generates m SCLK pulses in order to shift (in direction A) the data output from the corrector 140 to the TPH 160, and store the outputted data in units of m-bits in the 8-bit shift registers 161. Then, the data corresponding to the amount of one line and whose bit priority number corresponds to the number m is shifted (in direction B) and stored in parallel from the lowest to the most significant bit according to the PCLK pulses, which are generated by the clock generator 151. The shift register 161 may be referred to as a line buffer or line memory.

At the same time, the data composed of m units is latched by the latch signal LATCH according to the bit priority as shown in FIG. 5D. The signal shown in FIG. 5A represents m bytes of data, wherein the bits ($D_0$–$D_{n-1}$) of each byte are arranged according to the bit priority. The number m indicates the number of heating elements, and the number of the gradations is $2^n$ when the data is expressed in n-bit form.

Then, when the strobe signal ENABLE generated by the strobe signal generator 153 is input to the NAND gates (G0–G511), the desired image is expressed by causing the heating elements 163 to emit heat during a low strobe signal, with respect to the output of the latch register 162 thru NAND gates (G0–G511).

Meanwhile, the heat-emitting period of time for the strobe signal ENABLE from the strobe signal generator 153 changes according to the weighted value allotted by the bit priority as shown in FIG. 5E.

For example, the strobe signal for the period of time t is generated when the first bit or bit zero (i.e., the least significant bit (LSB) data) is latched, and the strobe signal for the period 2t is generated when the next bit or bit one (i.e., the second least significant bit of data) is latched, and the strobe signal for the period of 4t is generated when the next bit or bit two is latched. By this method, the strobe signal for the period of 128 t is generated when the eighth bit or bit seven (i.e., the most significant bit (MSB)) is latched. Here, t indicates the period time in which heat is emitted for one gradation and the weighted value is changeable depending on an experimentally obtained value.

When the print expression for one line of data of the same bit priority is finished, a PCLK pulse as shown in FIG. 5C is generated by the clock generator 151, and is applied to transfer the data in the B direction. In addition, the one line of data of the next priority bit moves by one bit. Then, the latch signal (FIG. 5D) is generated by the latch signal generator 152 and the data output by the shift register 161 is latched. The gradation is then expressed by applying the strobe signals (FIG. 5E) which are generated by the strobe signal generator 153 to the latch register.

As described hereinabove, the present invention does not compare the gradation but performs printing with the thermal print head wherein the line buffer is provided. In this manner, the amount of hardware necessary for printing is reduced, while at the same time the apparatus is capable of achieving high speed printing.

What is claimed is:

1. A thermal print head comprising:

a line buffer for storing m bytes of pixel data;

latching means, coupled to said line buffer, for latching one line unit of data at a time as output by said line buffer according to a predetermined bit sequence, wherein each line unit of data comprises m-bits of data according to the predetermined bit sequence; and a plurality of heating elements which emit heat for a period corresponding to a desired gradation level according to the data latched by said latching means, wherein m indicates the number of heating elements, and each of said m bytes of pixel data is expressed in n-bit form when the number of the gradations is $2^n$.

2. A thermal print head according to claim 1, further comprising driving means, including NAND gates having inputs coupled to outputs of said latching means, said driving means selectively causing said plurality of heating elements to emit heat in accordance with the outputs of said latching means.

3. A thermal print head according to claim 1, wherein said line buffer comprises m-bit shift registers for storing said m bytes of data according to the predetermined bit sequence.

4. A thermal printing apparatus comprising:

input means for receiving an image signal;

a frame memory, coupled to said input means, for storing said image signal in frame units;

a thermal print head comprising:

a line buffer for storing m bytes of pixel data;

a latch for latching one line unit of data at a time from said line buffer according to a predetermined bit sequence, wherein each line unit of data comprises m-bits of data according to a predetermined bit sequence;

a plurality of heating elements for emitting heat for a period corresponding to a desired gradation level according to the data latched by said latch;

control means for controlling reading and writing of data to and from said frame memory including outputting of m×n-bits of data from said frame memory to the line buffer of said thermal print head; and driving signal generating means for generating driving signals so as to control the emission of heat by said heating elements in accordance with the data stored in said line buffer, wherein m indicates the number of heating elements, and each of said m bytes of pixel data is expressed in n-bit form when the number of the gradations is $2^n$.

5. A thermal printing apparatus according to claim 4, wherein said driving signal generating means comprises:

a clock generator including means for generating serial clock pulses so as to shift and store said m bytes of pixel data from said frame memory into said line buffer one byte at a time, each byte having n bits arranged according to the predetermined bit sequence, and means for generating parallel clock pulses so as to shift, in parallel, said line units in synchronization from said line buffer to said latch according to the bit sequence;

a latch signal generator coupled to said latch, for generating a latch signal for controlling said latch so as to latch and store said one line unit of data which is stored in said line buffer according to the bit sequence; and a strobe signal generator which generates a strobe signal in order to control a period of time for emitting heat from said heating elements.

6. A thermal printing apparatus according to claim 5, wherein said strobe signal generator generates a strobe signal depending on a weighted value of the predetermined period of time for emitting heat in accordance with the bit sequence.

7. A thermal printing apparatus according to claim 6, wherein said weighted value is weighted by the value of $2^{n-1}$ depending on the predetermined bit sequence.

8. A thermal printing method for controlling a thermal printing apparatus to print using a thermal print head and line buffer which stores m bytes of data, said method comprising the steps of:

storing an image signal input from a signal source by frame units in a memory;

reading said frame units from said memory and storing said m bytes of pixel data into a line buffer of said thermal print head; and printing by causing heating elements of said thermal print head to emit heat for a period of time corresponding to a desired gradation level according to a line unit of data as output by said line buffer, wherein the line unit of data comprises m-bits of data according to a predetermined bit sequence, and m indicates the number of heating elements, and each of said m bytes of pixel data is expressed in n-bit form when the number of the gradations is $2^n$.

9. A thermal printing method according to claim 8, wherein said printing step performs printing by emitting heat according to the bit sequence for various heat-emitting periods.

10. A thermal print head as set forth in claim 1, wherein said latching means is parallel coupled to said line buffer.

11. A thermal print head as set forth in claim 4, wherein said latch is parallel coupled to said line buffer.

12. A thermal printing method as set forth in claim 8, wherein said line buffer is parallel coupled to said thermal print head.

13. A sublimate-type thermal printing apparatus, comprising:

a frame memory which receives and stores by frame units an image signal input from a signal source;

a selector which reads and selects R, G, and B signals from said frame memory;

a color converter which converts the image signal selected by said selector into a respective complimentary color and outputs the result;

a corrector which performs at least one of gamma-correction, resistance correction, temperature correction, and color correction on the output of said color converter to produce corrected data;

a driving signal generator which generates a parallel clock signal, a latch signal, and a strobe signal;

a thermal print head, comprising:

a line buffer for storing m bytes of the corrected data in response to the parallel clock signal;

a latch register coupled to said line buffer for latching, in response to the latch signal, one line unit of data at a time as output by said line buffer according to a predetermined bit sequence, wherein each line unit of data comprises m bits of data according to the predetermined bit sequence;

a plurality of heating elements for emitting heat for a period corresponding to a desired gradation level according to the data latched by said latch register and the strobe signal, wherein m indicates the number of heating elements, and each of said m bytes of the corrected data is expressed in n-bit form when the number of the gradations is $2^n$; and a controller for controlling reception of the image signal by said frame memory and for controlling the reading of the R, G, and B signals from said frame memory by said selector.

* * * * *